US010106319B2

(12) United States Patent
Adam et al.

(10) Patent No.: US 10,106,319 B2
(45) Date of Patent: Oct. 23, 2018

(54) METHOD OF AUTOMATICALLY DETERMINING A FILLING LEVEL OF A PLASTIC BAG, AND A UNIT FOR PERFORMING SUCH A METHOD

(71) Applicant: ANTALIOS, Marseilles (FR)

(72) Inventors: Patrick Adam, La Ciotat (FR); Christophe Pistoresi, Les Pennes Mirabeau (FR)

(73) Assignee: ANTALIOS, Marseilles (FR)

( * ) Notice: Subject to any disclaimer, the term of this patent is extended or adjusted under 35 U.S.C. 154(b) by 70 days.

(21) Appl. No.: 15/452,829

(22) Filed: Mar. 8, 2017

(65) Prior Publication Data

US 2017/0261362 A1 Sep. 14, 2017

(30) Foreign Application Priority Data

Mar. 10, 2016 (FR) ..... 16 52011

(51) Int. Cl.
*B65F 1/14* (2006.01)

(52) U.S. Cl.
CPC ..... *B65F 1/1415* (2013.01); *B65F 2210/128* (2013.01); *B65F 2210/1443* (2013.01)

(58) Field of Classification Search
CPC ..... B65F 1/0006; B65F 1/1415; B65F 2210/1443; G01F 23/292–23/2928
See application file for complete search history.

(56) References Cited

U.S. PATENT DOCUMENTS 5,225,689 A * 7/1993 Buckle ..... G01S 17/87 250/221
5,446,281 A * 8/1995 Taranowski ..... G01C 3/08 250/221
6,050,485 A 4/2000 Brito
8,631,697 B2 * 1/2014 Di Giugno ..... B65F 1/06 73/304 C
8,692,140 B1 * 4/2014 Pollock ..... A61B 5/6891 177/15
9,347,817 B2 * 5/2016 Pollock ..... G01G 19/387
2007/0029372 A1 2/2007 Owen
2009/0126473 A1 * 5/2009 Porat ..... B65F 1/1426 73/149
2015/0298903 A1 10/2015 Luxford

FOREIGN PATENT DOCUMENTS

CH 701677 A2 2/2011

* cited by examiner

*Primary Examiner* — Justin Olamit
(74) *Attorney, Agent, or Firm* — MH2 Technology Law Group, LLP

(57) ABSTRACT

The disclosure provides a method of automatically determining a filling level of a plastic bag fastened via an open end to a vertical post forming a support, the method comprising a step of detecting that the bag has reached a predetermined filling level by means of a first distance sensor positioned on the post, a step of measuring the distance of the bag relative to the post by means of a second distance sensor positioned on the post, step of detecting the presence of the bag fastened via an open end to the post by means of a third distance sensor positioned on the post, and a step of detecting a filling level on the basis of the measurements taken by the distance sensors. The disclosure also provides a unit for performing such a method.

10 Claims, 3 Drawing Sheets

METHOD OF AUTOMATICALLY DETERMINING A FILLING LEVEL OF A PLASTIC BAG, AND A UNIT FOR PERFORMING SUCH A METHOD

TECHNICAL FIELD

The present disclosure relates to the general field of determining the filling levels of plastic bags that are used in particular as waste containers on various sites of large size (public or private spaces), such as stations, airports, commercial centers, town centers in a built-up area, etc.

BACKGROUND OF THE DISCLOSURE

In public and private spaces, the handling of waste by municipal services or by service providers includes in particular rounds for regularly emptying the various waste containers in the form of plastic bags so as to collect the waste therein. Typically, these rounds are fixed in a precise timetable with a time interval of predetermined duration between two passes of a sanitation worker for emptying the containers.

That way of proceeding is sub-optimal, since it lacks flexibility. Specifically, when waste collection rounds are at planned times, the containers are not always full and therefore do not necessarily need to be emptied. Conversely, some of the containers present on a sanitation worker's collection run may become full more quickly than others, and as a result, may require emptying before the next planned round in order to avoid any detrimental overflowing.

OBJECT AND SUMMARY OF THE DISCLOSURE

An object of the present disclosure is thus to mitigate such drawbacks by proposing a method of automatically determining a filling level of a plastic bag, regardless of whether it is transparent or opaque.

In accordance with the disclosure, this object is achieved by a method of automatically determining a filling level of a plastic bag fastened via an open end to a vertical post forming a support, the method comprising:

- a step of detecting that the bag has reached a predetermined filling level by means of a first distance sensor positioned on the post;
- a step of measuring the distance of the bag relative to the post by means of a second distance sensor positioned on the post;
- a step of detecting the presence of the bag fastened via an open end to the post by means of a third distance sensor positioned on the post; and
- a step of detecting a filling level of the bag on the basis of the measurements taken by the distance sensors.

The method of the disclosure is remarkable in that it makes it possible to monitor a collection of plastic bag waste containers situated on a particular site. Specifically, as soon as a plastic bag reaches a predetermined filling level (e.g. corresponding to 50% of the total height of the container), a warning message is sent to a management station, which can then plan the next visit by a sanitation worker for emptying the plastic bag and collecting the waste, and thus avoid any untimely overflowing of the waste container. The method of the disclosure thus makes it possible to give great flexibility to sanitation workers in organizing their rounds for emptying waste containers on a given site.

The method of the disclosure is also remarkable in that it makes it possible to verify the distance of the bag relative to the post supporting the bag. This step makes it possible to validate or to invalidate any detection of the bag reaching a predetermined filling level. Specifically, given the flexibility and the light weight of the plastics material constituting the bag, it is possible that wind (when the waste container is in the open air) or a draft (when the waste container is in an indoor space) causes the edges of the bag to move, leading to the risk of the first distance sensor that is dedicated to detecting the filling level of the bag confusing a detection of the edge of the bag moving under the effect of wind with a detection of an opaque element in the bag, and then sending a bag-full warning message that is erroneous. As a result, this step makes it possible to avoid sending a bag-full warning message that is not valid.

The method of the disclosure is also remarkable in that it makes it possible to verify whether the plastic bag is indeed present in order to warn the sanitation worker, where appropriate. In the event of not detecting the presence of the bag, the sanitation worker can thus immediately take action to replace the bag.

The step of detecting that the bag has reached a predetermined filling level may comprise the first distance sensor emitting electromagnetic radiation through the bag, the first distance sensor calculating a relative distance to any waste present in the bag on the basis of any reflected radiation it receives, and comparing the relative distance to any waste present in the bag with a predetermined filling threshold.

Under such circumstances, the predetermined filling threshold may correspond to a distance between the first distance sensor and an edge furthest away from said distance sensor, this distance being calculated automatically by said first distance sensor during a prior step of putting the bag into place on the post.

The step of measuring the distance of the bag relative to the post may comprise the second distance sensor emitting electromagnetic radiation towards the bag, and the second distance sensor receiving the radiation reflected by the bag to deduce therefrom a measurement of the distance of the bag relative to the post.

Under such circumstances, the method further comprises, in the event of detecting that the bag has reached the predetermined filling level, a step of sending a bag-full warning message if the measured distance of the bag relative to the post is less than or equal to a predetermined threshold distance corresponding to no wind, and a step of canceling the detection that the bag has reached the predetermined filling level if the measured distance of the bag relative to the post is greater than the predetermined threshold distance corresponding to no wind.

The step of detecting the presence of the bag may comprise in succession: the third distance sensor emitting electromagnetic radiation towards an attachment element for attaching the open end of the bag to the post, calculating a distance relating to the presence of the bag from radiation reflected by the bag and received by the third distance sensor, and comparing the distance relating to the presence of the bag with a predetermined distance.

The method may further comprise a step of sending a no-bag warning message in the event of the presence of the bag not being detected.

The step of detecting that the bag has reached a predetermined filling level may be repeated over a predetermined minimum duration in order to avoid any false detection of the filling level being reached. For example, it is possible to select a minimum duration of the order of 10 seconds to 15 seconds during which detecting whether the bag has reached a predetermined filling level is performed continuously so as to avoid sending a bag-full warning message merely as a result of a piece of waste dropped into the plastic bag going past the first sensor.

The first distance sensor (for detecting that the bag has reached a predetermined filling level) may be positioned on the post in a top half of said post and it may emit electromagnetic radiation towards the plastic bag along a substantially horizontal axis.

Also, the method may comprise a step of detecting a level of charge of a power supply battery for the distance sensors, and a step of sending a battery level warning message if the level of charge of the distance sensor power supply battery is less than a predetermined charge threshold level. Thus, the sanitation worker can be warned when the level of charge of the power supply battery is low in order to plan replacing the battery.

The disclosure also provides a unit for determining a filling level of a plastic bag in order to perform the method as defined above, the unit comprising first, second, and third distance sensors, a power supply battery for said distance sensors, and a communication module for transmitting and receiving data coming from the distance sensors. The distance sensors may be infrared sensors.

BRIEF DESCRIPTION OF THE DRAWINGS

Other characteristics and advantages of the present disclosure appear from the following description made with reference to the accompanying drawings, which show an implementation having no limiting character. In the figures.

DETAILED DESCRIPTION

Figure 1:
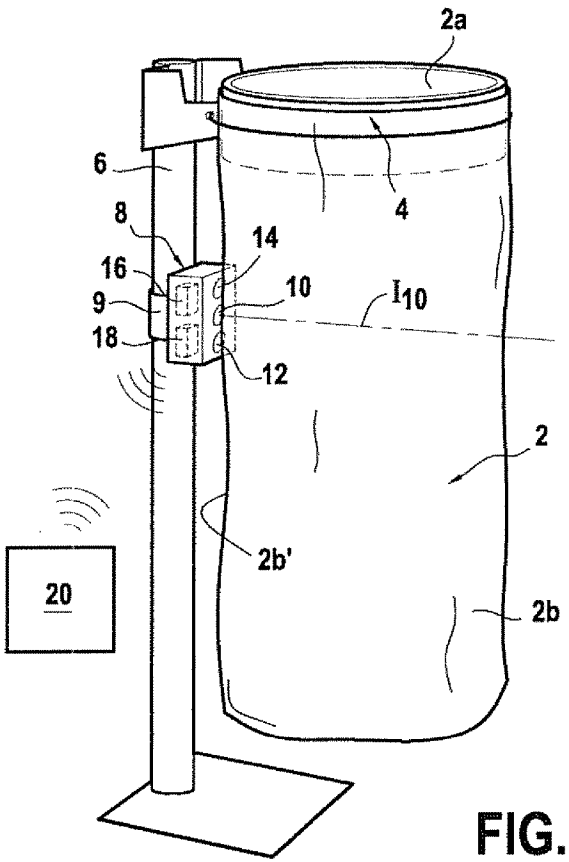
FIG. 1 is a diagrammatic view showing a unit fastened on a pole for supporting a plastic bag, the unit serving to perform the determination method of the disclosure.

The disclosure applies to automatically determining a filling level of a transparent or opaque plastic bag that is fastened via an open end to a vertical post constituting a support, such as the plastic bag 2 shown in FIG. 1 and acting in this example as a waste bag.

In known manner, this plastic bag 2, which may be transparent or opaque to light, is fastened via its open end 2*a* to a ring 4, itself mounted on a vertical post 6 forming a container support. This type of container is commonly used in various public or private sites, such as stations, airports, commercial centers, centers in built-up areas, etc., in order to receive waste.

According to the disclosure, provision is made to fasten an electronic unit 8 on the post 6 by conventional fastener means 9 in order to determine automatically a filling level of the plastic bag 2.

As shown in FIG. 1, the unit 8 comprises a plurality of different distance sensors, namely a first distance sensor 10 specifically for detecting that the bag has reached a predetermined filling level, a second distance sensor 12 for measuring the distance of the bag relative to the post, and a third distance sensor 14 for detecting the presence of the bag.

The distance sensors 10 to 14 may be sensors of the infrared type. In well-known manner, each of the sensors comprises an infrared radiation emitter, a photodiode that receives the radiation reflected by an article placed on the path of the laser beam, and processor means for processing the reflected radiation in order to calculate the distance between the sensor and the article that reflected the infrared radiation.

The distance sensors 10 to 14 are powered by an independent power supply battery 16. This battery, and the various distance sensors 10 to 14, are also connected to a communication module 18 for transmitting and receiving data.

The communication module 18 includes a storage memory and it is capable of transmitting, by wire or wirelessly, the distance data from the various distance sensors together with data about the level of charge of the battery 16 to a remote receiver 20, typically a station for managing waste collection. Furthermore, the communication module can receive from this receiver data for activating the distance sensors 10 to 14, and/or for putting them on standby.

Figure 2:
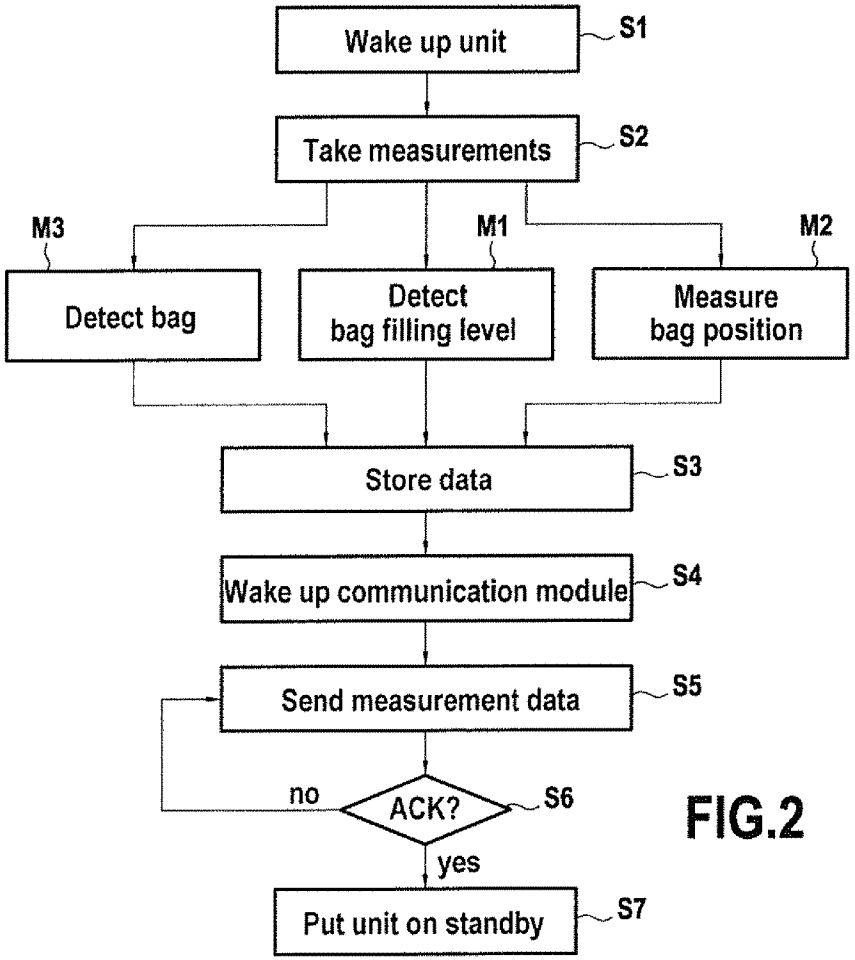
FIG. 2 is a flowchart showing the sequencing of steps of the determination method of the disclosure.

FIG. 2 is a flowchart showing the sequencing of various steps of the detection method of the disclosure as implemented using such an electronic unit fastened to the post of a plastic bag waste container.

The first step S1 of the method consists in "waking up" the electronic unit for automatically determining a filling level of the plastic bag, i.e. in activating the various distance sensors. This waking up may be performed automatically at a time interval that is a function of the site where the waste container is located (e.g. once every 10 minutes) or under remote control from a management station.

During the following step S2, the electronic unit takes various measurements (as described in greater detail below), namely: a measurement M1 for detecting that the plastic bag has reached a predetermined filling level; a measurement M2 of the distance of the plastic bag relative to the second distance sensor; and a measurement M3 for detecting that a plastic bag fastened to the waste container post is indeed present.

These three measurements M1 to M3 may be taken simultaneously or one after another, it being understood that the sequencing of the measurements is of no importance.

The data coming from these three measurements is then stored in the storage memory of the communication module of the electronic unit (step S3). The data transmission and reception means of the communication module are then woken up (step S4) in order to enable the data stored in the storage memory to be sent to the management station during a step S5.

Provision may be made for the communication module of the electronic unit to remain on standby until it has received an acknowledgement coming from the management station (step S6). Once the communication module has indeed received the acknowledgement from the management station, the electronic module switches to standby mode (step S7) until the next time it is woken up.

According to some embodiments, the method may also include, before or after step S2, a step of detecting the level of charge of the battery powering the distance sensors. If this level of charge of the battery is lower than a predetermined threshold level of charge (e.g. corresponding to 20% of maximum charge), this data is stored together with the other data in the storage memory of the communication module of the electronic unit, and it is sent to the management station in the form of a battery level warning message. A sanitation worker should then be sent promptly on site to change the power supply battery.

Figure 4:
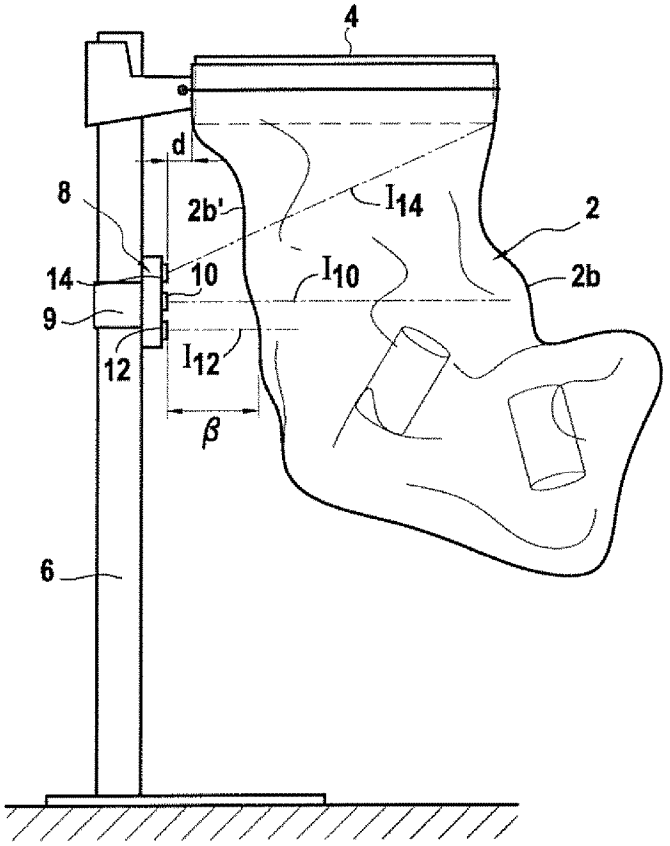
FIG. 4 shows an implementation of the step of measuring the relative distance of the bag in the method of the disclosure.
Figure 3:
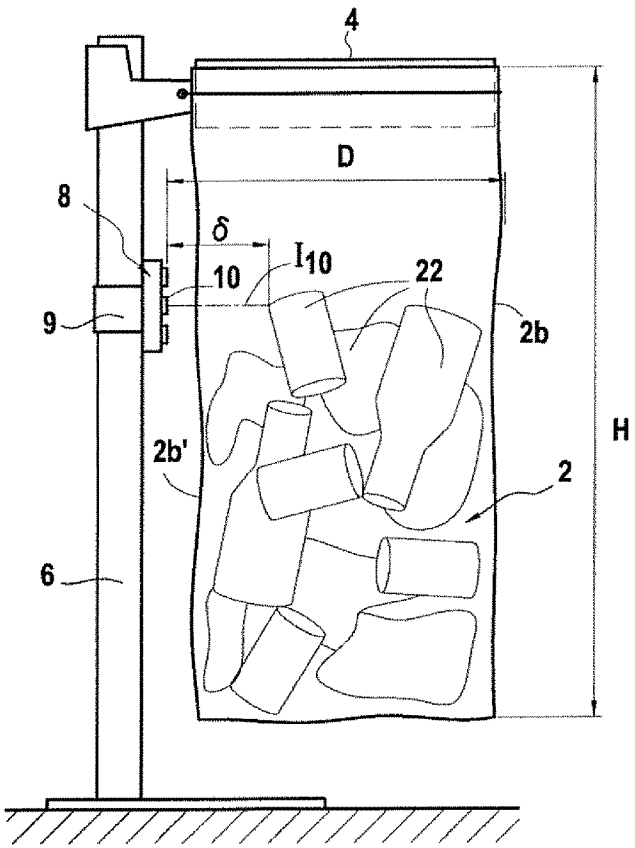
FIG. 3 shows an implementation of the step of detecting that a bag has reached a predetermined filling level in the method of the disclosure.
Figure 5:
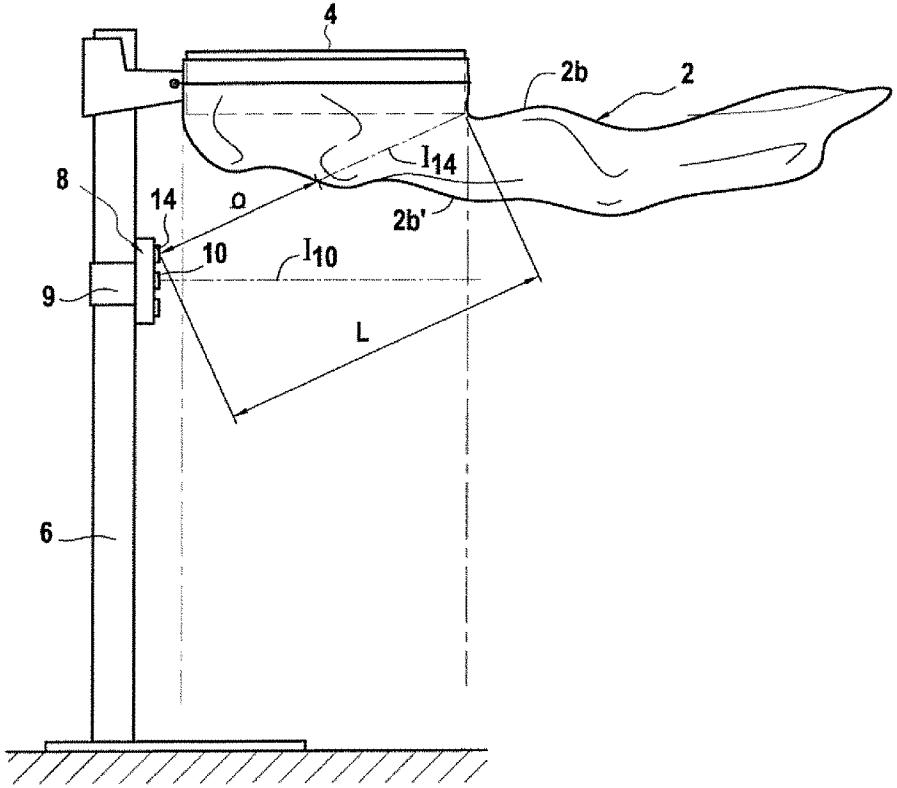
FIG. 5 shows more precisely an example of implementing the step of detecting the presence of a bag in the method of the disclosure.

With reference to FIGS. 3 to 5, there follows a more detailed description of the various measurements M1 to M3 taken during the step S2 of the detection method.

The measurement M1 for detecting that the plastic bag has reached a predetermined filling level is shown in FIG. 3. This measurement, which is performed by the first distance sensor 10 of the electronic unit, is for detecting whether the level to which the plastic bag has been filled with waste 22 has reached a previously defined filling level (e.g. corresponding to 50% of the height H of the plastic bag 2).

For this purpose, the first distance sensor 10 is positioned on the post 6 in the top half of said post and it emits electromagnetic radiation $I_{10}$ towards the plastic bag 2 along a substantially horizontal axis.

The radiation that is reflected (by the edge 2*b* of the plastic bag that is furthest away from the first distance sensor, or by waste present inside the plastic bag on the path of the electromagnetic radiation $I_{10}$) is received by the first distance sensor 10 and serves to calculate a relative distance δ to waste present in the bag, if any.

This distance δ is then compared with a predetermined filling threshold, which threshold is obtained during a calibration step carried out when putting the plastic bag into place on the post.

The purpose of the calibration step is to measure automatically the distance D between the first distance sensor and the remote edge 2*b* of the bag (see FIG. 1).

Since it is considered that the first distance sensor is very close to the bag 2, possibly in contact therewith, the distance D measured during this calibration step corresponds substantially to the width of the plastic bag when it is in place on the post (and thus empty), i.e. to the distance between its opposite edges 2*b* and 2*b'*.

Thus, when the distance δ is measured as being substantially equal to the distance D corresponding to the predetermined filling threshold, the first distance sensor 10 sends "bag not full" data to the communication module 18, which stores this information in its storage memory.

Conversely, when the distance δ is measured as being less than the distance D corresponding to the predetermined filling threshold (as shown in FIG. 3), the first distance sensor 10 sends "bag-full" data to the communication module 18, which stores this information in its storage memory.

The measurement M1 may be repeated over a predetermined minimum duration in order to avoid any false detection of the filling level of the bag, and in particular to avoid the possibility of a piece of waste being dropped into the bag and going past the first distance sensor while the measurement M1 is being taken erroneously triggering "bag-full" data being sent (when the bag is not full).

For example, a minimum duration of the order of 10 seconds to 15 seconds may be selected during which the measurement M1 is taken continuously. If, during this measurement time interval, it is found that the distance δ is less than the predetermined filling threshold but then becomes once more substantially identical to that threshold, the first distance sensor sends "bag not full" data to the communication module.

The measurement M2 of the distance β of the bag relative to the post is shown in FIG. 4. This measurement M2 is taken by the second distance sensor 12 for the purpose of validating the measurement M1. Specifically, if it is detected that this distance is greater than expected, it is assumed that the bag is not correctly positioned for making the measurement M1 reliable (as might happen if there is a wind), so that measurement is then canceled.

For this purpose, the second distance sensor 12 emits electromagnetic radiation $I_{12}$ towards the plastic bag 2 along a substantially horizontal axis.

The radiation reflected by the edge 2*b'* of the plastic bag that is closest to the second distance sensor is received by the second distance sensor and is used to deduce a measurement of the distance β of the bag relative to the post.

This distance β is then compared with a predetermined threshold distance $\underline{d}$ corresponding to no wind. This threshold distance $\underline{d}$ is substantially equal to the distance between the second distance sensor and the edge 2*b'* of the bag when the bag is fastened to the post. In practice, this threshold distance $\underline{d}$ is of the order of 5 centimeters (cm).

The result of this comparison between the distance β and the threshold distance $\underline{d}$ is sent to the communication module 18, which stores this information in its storage memory.

The measurement M3 for detecting the presence of a bag fastened via an open end 2*a* to the post 6 is shown in FIG. 5. This measurement is taken by the third distance sensor 14 positioned on the post. Its purpose is to ensure that the plastic bag is indeed in place and has not become detached from the ring 4 on which it was fastened (in particular under the effect of a strong wind).

This step of detecting the presence of the bag comprises in particular emitting, from the third distance sensor, electromagnetic radiation $I_{14}$ towards an attachment element for attaching the open end 2*a* of the bag 2 to the post. In the example shown in FIG. 5, this radiation is oblique relative to the horizontal and it is directed towards the far end of the ring 4.

On the basis of the radiation reflected by the bag (or the ring as the case may be) and received by the third distance sensor, it calculates a distance Ω relating to the presence of the bag, with this distance Ω then being compared with a predetermined distance L substantially equal to the distance between the third distance sensor 14 and the far end of the ring 4.

The result of this comparison between the distance Ω and the predetermined distance L is sent to the communication module 18, which stores this information in its storage memory.

All of the data obtained by the measurements M1, M2, and M3 is sent to the management station 20 where it is processed as follows.

When the measurement M1 has made it possible to send "bag-full" data to the communication module and when the distance β of the bag relative to the second distance sensor is less than or equal to the predetermined threshold distance $\underline{d}$ corresponding to no wind (measurement M2), a bag-full warning message is sent to a sanitation worker to take action and empty the bag in question.

When the measurement M1 has made it possible to send "bag-full" data to the communication module and the distance of the bag β relative to the second distance sensor is greater than the predetermined threshold distance $\underline{d}$ corresponding to no wind, detection that the bag has reached the predetermined filling level is canceled (the "bag-full" data is deleted) and no warning message is sent. Specifically, under such circumstances, it is considered that the measurement M1 is not reliable because of the wind lifting the plastic bag.

When the measurement M3 has indicated that the distance Ω is less than the predetermined distance L, it is considered that the bag is indeed present, even if the measurements M1 and M2 have not enabled a reliable measurement to be taken (e.g. as a result of a strong wind causing the plastic bag to take up an almost horizontal position, as shown in FIG. 5).

Conversely, when the measurement M3 has indicated that the distance Ω is equal to the predetermined distance L, it is considered that the bag is missing, and a missing-bag warning message is sent to a sanitation worker in order to replace it.

What is claimed is:

1. A method of automatically determining a filling level of a plastic bag fastened via an open end to a vertical post forming a support, the method comprising:

detecting that the bag has reached a predetermined filling level by means of a first distance sensor positioned on the post;

measuring a first distance of the bag relative to the post by means of a second distance sensor positioned on the post;

detecting a presence of the bag fastened via an open end to the post by means of a third distance sensor positioned on the post; and detecting a filling level based on the detecting that the bag has reached a predetermined filling level, the measuring a first distance of the bag relative to the post, and the detecting a presence of the bag.

2. A method according to claim 1, wherein the detecting that the bag has reached a predetermined filling level comprises:

the first distance sensor emitting electromagnetic radiation through the bag;

the first distance sensor calculating a relative distance to any waste present in the bag based on reflected electromagnetic radiation the first distance sensor receives; and comparing the relative distance to any waste present in the bag with a predetermined filling threshold.

3. A method according to claim 2, wherein the predetermined filling threshold corresponds to a second distance between the first distance sensor and an edge of the bag furthest away from said first distance sensor, said second distance being calculated automatically by said first distance sensor during a prior step of putting the bag into place on the post.

4. A method according to claim 1, wherein the measuring a first distance of the bag relative to the post comprises:

the second distance sensor emitting electromagnetic radiation towards the bag; and the second distance sensor receiving the electromagnetic radiation reflected by the bag to deduce therefrom a measurement of the first distance of the bag relative to the post.

5. A method according to claim 4, comprising, in a case of detecting that the filling level has reached the predetermined filling level:

a step of sending a bag-full warning message if the first distance of the bag relative to the post is less than or equal to a predetermined threshold distance corresponding to no wind; and a step of canceling the detection that the bag has reached the predetermined filling level if the first distance of the bag relative to the post is greater than the predetermined threshold distance corresponding to no wind.

6. A method according to claim 1, wherein the detecting a presence of the bag comprises in succession:

the third distance sensor emitting electromagnetic radiation towards an attachment element for attaching the open end of the bag to the post;

calculating a third distance relating to the presence of the bag from electromagnetic radiation reflected by the bag and received by the third distance sensor; and comparing the third distance relating to the presence of the bag with a predetermined distance.

7. A method according to claim 1, further comprising a step of sending a no-bag warning message in a case of the presence of the bag not being detected.

8. A method according to claim 1, wherein the step of detecting that the bag has reached a predetermined filling level is repeated over a predetermined minimum duration in order to avoid any false detection of the filling level being reached.

9. A method according to claim 1, wherein the first distance sensor is positioned on the post on a top half of said post and the first distance sensor emits electromagnetic radiation towards the plastic bag along a substantially horizontal axis.

10. A method according to claim 1, further comprising a step of detecting a level of charge of a power supply battery for the first, second and third distance sensors, and a step of sending a battery level warning message if the level of charge of the power supply battery is less than a predetermined charge threshold level.

* * * * *